US011085599B2

(12) United States Patent
Bernard et al.

(10) Patent No.: US 11,085,599 B2
(45) Date of Patent: Aug. 10, 2021

(54) OVERHEAD LIGHT FIXTURES AND METHODS

(71) Applicant: IDEAL Industries Lighting LLC, Racine, WI (US)

(72) Inventors: Randall Levy Bernard, Durham, NC (US); Kurt S. Wilcox, Libertyville, IL (US); Kurt Schreib, Milwaukee, WI (US); Bin Hou, San Jose, CA (US); Jeremy Richard Sorenson, Oak Creek, WI (US); Anthony T. Schauf, Franksville, WI (US); Scott Fisher, Raleigh, NC (US)

(73) Assignee: IDEAL industries Lighting LLC, Racine, WI (US)

( * ) Notice: Subject to any disclaimer, the term of this patent is extended or adjusted under 35 U.S.C. 154(b) by 0 days.

(21) Appl. No.: 16/891,962

(22) Filed: Jun. 3, 2020

(65) Prior Publication Data

US 2020/0386377 A1 Dec. 10, 2020

Related U.S. Application Data

(60) Provisional application No. 62/857,805, filed on Jun. 5, 2019.

(51) Int. Cl.
*F21S 8/02* (2006.01)
*F21V 23/00* (2015.01)
(Continued)

(52) U.S. Cl.
CPC ..... *F21S 8/026* (2013.01); *F21S 8/04* (2013.01); *F21V 23/006* (2013.01);
(Continued)

(58) Field of Classification Search
CPC ..... F21S 8/026; F21S 8/04; F21V 23/006; F21V 23/007; F21V 23/0471
(Continued)

(56) References Cited

U.S. PATENT DOCUMENTS 3,643,089 A * 2/1972 Marantz ..... F21S 8/02 362/217.02
5,134,557 A * 7/1992 Gordin ..... F21S 8/033 362/261
(Continued)

FOREIGN PATENT DOCUMENTS

AU 2010246459 A1 6/2011

*Primary Examiner* — Bryon T Gyllstrom
(74) *Attorney, Agent, or Firm* — Withrow & Terranova, P.L.L.C.

(57) ABSTRACT

An overhead light fixture includes a driver assembly and a light-emitting assembly. The driver assembly includes a driver and a housing. The light-emitting assembly is operably connected to the driver and configured for downward emission of light from a light source of the light-emitting assembly. The light-emitting assembly is detachably secured to the driver assembly. The light fixture is configured to be mounted to a canopy sheet of an overhead canopy, with the driver assembly disposed above the canopy sheet and the light-emitting assembly disposed below the canopy sheet. The driver assembly is optionally configured so that, when the light-emitting assembly is detached from the driver assembly, the driver is removable downwardly through the base portion. A bezel is optionally disposed around a lens of the light-emitting assembly, for aesthetic reasons and/or for controlling a degree of lateral emission of light from the light fixture.

20 Claims, 11 Drawing Sheets

(51) Int. Cl.
*F21V 23/04* (2006.01)
*F21S 8/04* (2006.01)
*F21Y 115/10* (2016.01)

(52) U.S. Cl.
CPC ..... *F21V 23/007* (2013.01); *F21V 23/0471* (2013.01); *F21Y 2115/10* (2016.08)

(58) Field of Classification Search
USPC ..... 362/147
See application file for complete search history.

(56) References Cited

U.S. PATENT DOCUMENTS

| | | | | |
|---|---|---|---|---|
| 7,066,617 | B2 * | 6/2006 | Mandy | B66B 11/0233 362/147 |
| 9,169,983 | B2 * | 10/2015 | Miletich | F21V 23/007 |
| 9,182,096 | B2 | 11/2015 | Kinnune et al. | |
| 10,551,044 | B2 * | 2/2020 | Peng | F21S 8/02 |
| 10,663,153 | B2 * | 5/2020 | Nikooyan | F21V 23/06 |
| 2015/0092417 | A1 * | 4/2015 | Hoog | F21S 8/026 362/277 |
| 2015/0308662 | A1 * | 10/2015 | Vice | F21V 21/30 362/282 |
| 2017/0059135 | A1 * | 3/2017 | Jones | F21V 17/002 |
| 2017/0074503 | A1 | 3/2017 | Horng et al. | |
| 2018/0100634 | A1 * | 4/2018 | Hierzer | F21V 21/025 |

* cited by examiner

OVERHEAD LIGHT FIXTURES AND METHODS

The present application claims the benefit of U.S. Provisional Application No. 62/857,805, filed 5 Jun. 2019, the disclosure of which is incorporated herein by reference in its entirety.

BACKGROUND

The present disclosure relates generally to overhead light fixtures and, more particularly, to canopy-mounted light fixtures and to methods for servicing the same.

Note that in describing the overhead light fixtures and advantages herein, particular reference may be made to what is referred to as canopy light fixtures; however, the apparatus and methods described herein are more generally applicable to overhead lighting fixtures, and in some cases to light fixtures in other mounting locations, orientations and positions.

Canopy-mounted light fixtures ("fixtures") are often used to provide lighting in areas such as service stations, drive-through facilities such as banks, and other outdoor lighting environments which are generally lighted from above. Several varieties of canopy-mounted light fixtures have been developed. For example, see the prior art fixtures disclosed in U.S. Pat. Nos. 9,169,983 and 9,182,096. Some of the canopy-mounted light fixtures of the prior art have part or substantially all of their structures located above, rather than below the generally horizontal planar structure which forms the "ceiling" of the canopy when in their use positions. Such planar structure will be referred to herein as the "canopy sheet." Above-sheet positioning of light fixtures is often deemed preferential from a design point of view because what appears overhead may be simply a rectangular or circular light emission area, rather than a bulky light fixture structure. However, such canopy-mounted light fixtures may present difficulty related to initial positioning of the light fixtures and/or servicing. Indeed, when such light fixtures are positioned primarily above the canopy sheet, servicing may be particularly difficult and time-consuming when the parts to be serviced are located above the canopy sheet.

It would be desirable and economically advantageous to be able to easily service and replace functioning elements of the overhead light fixture, such as replacing or servicing LED drivers, while retaining the portions of the light fixture in place above the canopy sheet. Some efforts have been directed toward this goal. For example, the light fixture described in the '983 patent allows removal of the driver tray assembly from below the canopy sheet for servicing. However, the light fixtures of the '983 patent may not be suitable for some situations, such as when a beam of the canopy support structure is located in close proximity to the desired mounting position.

As such, there remains a need for a low-cost and easily serviceable overhead canopy light fixtures, and related methods.

BRIEF SUMMARY

Embodiments of the present disclosure generally relate to an overhead light fixture, and related methods. In general, the light fixture includes a driver assembly and a light-emitting assembly. The driver assembly includes a driver and a housing. The light-emitting assembly is operably connected to the driver and configured for downward emission of light from a light source of the light-emitting assembly. The light-emitting assembly is detachably secured to the driver assembly. The light fixture is configured to be mounted to a canopy sheet of an overhead canopy, with the driver assembly disposed above the canopy sheet and the light-emitting assembly disposed below the canopy sheet. A bezel is optionally disposed around a lens of the light-emitting assembly, for aesthetic reasons and/or for controlling a degree of lateral emission of light from the light fixture.

In particular, one or more embodiments include an overhead light fixture for mounting to a canopy. The light fixture includes a driver assembly and a light-emitting assembly. The driver assembly includes a driver and a housing; with the housing having a base portion and a sleeve portion extending upwardly from the base portion at an angle less than vertical. The driver is detachably mounted in the sleeve portion. The light-emitting assembly is operably connected to the driver and configured for downward emission of light from a light source of the light-emitting assembly. The light-emitting assembly is detachably secured to the base portion of the driver assembly. The driver assembly is configured so that, when the light-emitting assembly is detached from base portion, the driver is removable downwardly through the base portion.

Other embodiments include an overhead light fixture for mounting to a canopy that includes a driver assembly, a light-emitting assembly, and a bezel. The driver assembly includes a driver and a housing. The housing has a base portion and a sleeve portion extending upwardly from the base portion. The driver is mounted in the sleeve portion. The light-emitting assembly is disposed below the driver assembly and detachably secured to the base portion of the driver assembly. The light-emitting assembly has a lens configured for downward and lateral emission of light from a light source of the light-emitting assembly. The bezel peripherally surrounds the lens and controls a degree of lateral emission of light from the light fixture. The driver assembly is configured so that, when the light-emitting assembly is detached from base portion, the driver is removable downwardly through the base portion.

One or more other embodiments include a method of servicing an overhead light fixture installed in an overhead canopy. The canopy has a canopy sheet and a fixture-receiving opening therethrough. The overhead light fixture includes a driver assembly and a light-emitting assembly. The light-emitting assembly detachably secured to the canopy and configured for downward emission of light from a light source of the light-emitting assembly. The driver assembly includes a driver operatively connected to the light source. The driver assembly is disposed above the canopy and the light-emitting assembly is disposed below the canopy. The method includes dismounting the light-emitting assembly from the canopy; thereafter, removing the driver from below the canopy by moving the driver downward out the fixture-receiving opening; while the driver is removed, servicing or replacing the driver with a replacement driver; installing the serviced or replacement driver by moving the serviced or replacement driver upward through the fixture-receiving opening; and remounting the light-emitting assembly to the canopy and operatively connecting the light-emitting assembly to the serviced or replacement driver.

Of course, those skilled in the art will appreciate that the present embodiments are not limited to the above contexts or examples, and will recognize additional features and advantages upon reading the following detailed description and upon viewing the accompanying drawings.

DETAILED DESCRIPTION

Figure 1:
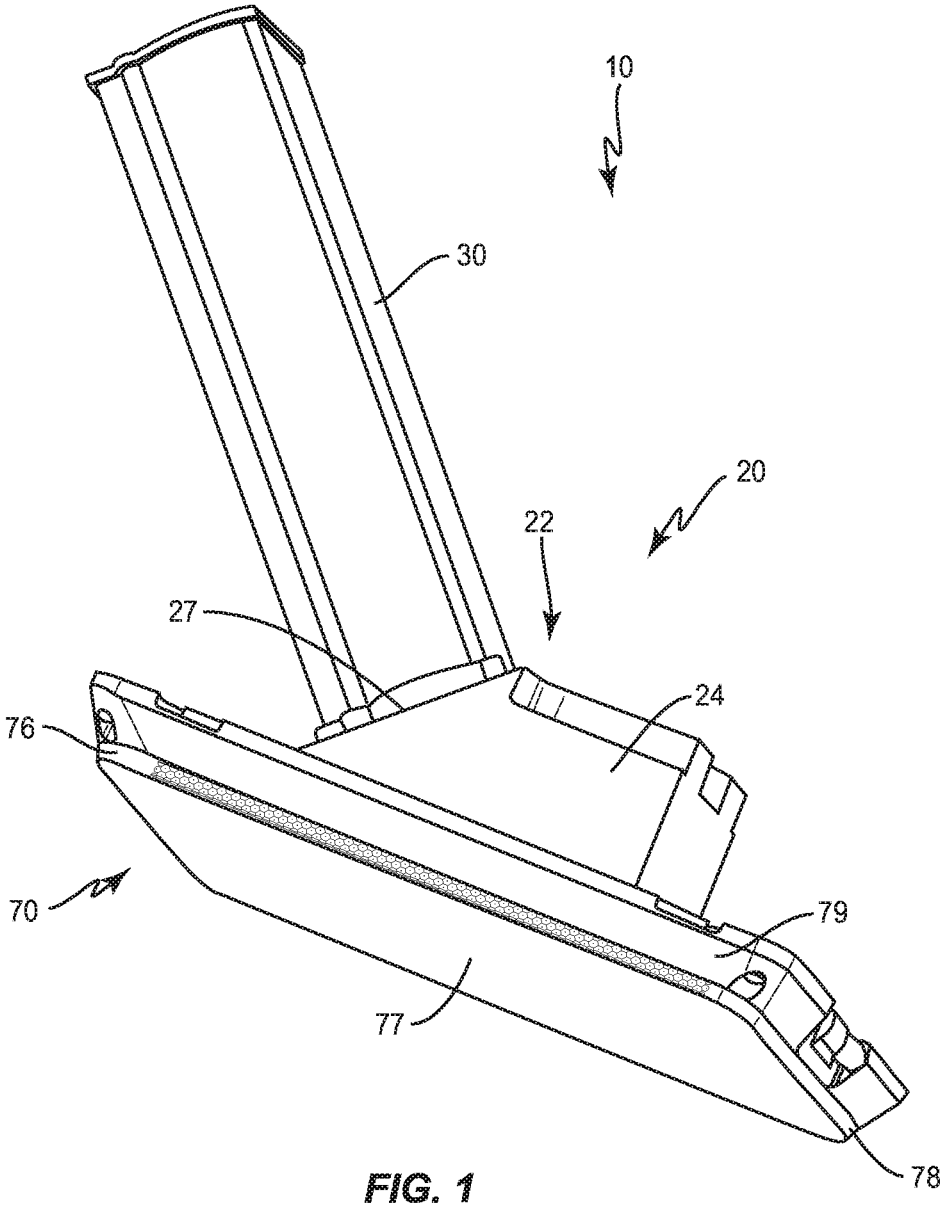
FIG. 1 is a perspective view of a light fixture according to one or more embodiments.
Figure 2:
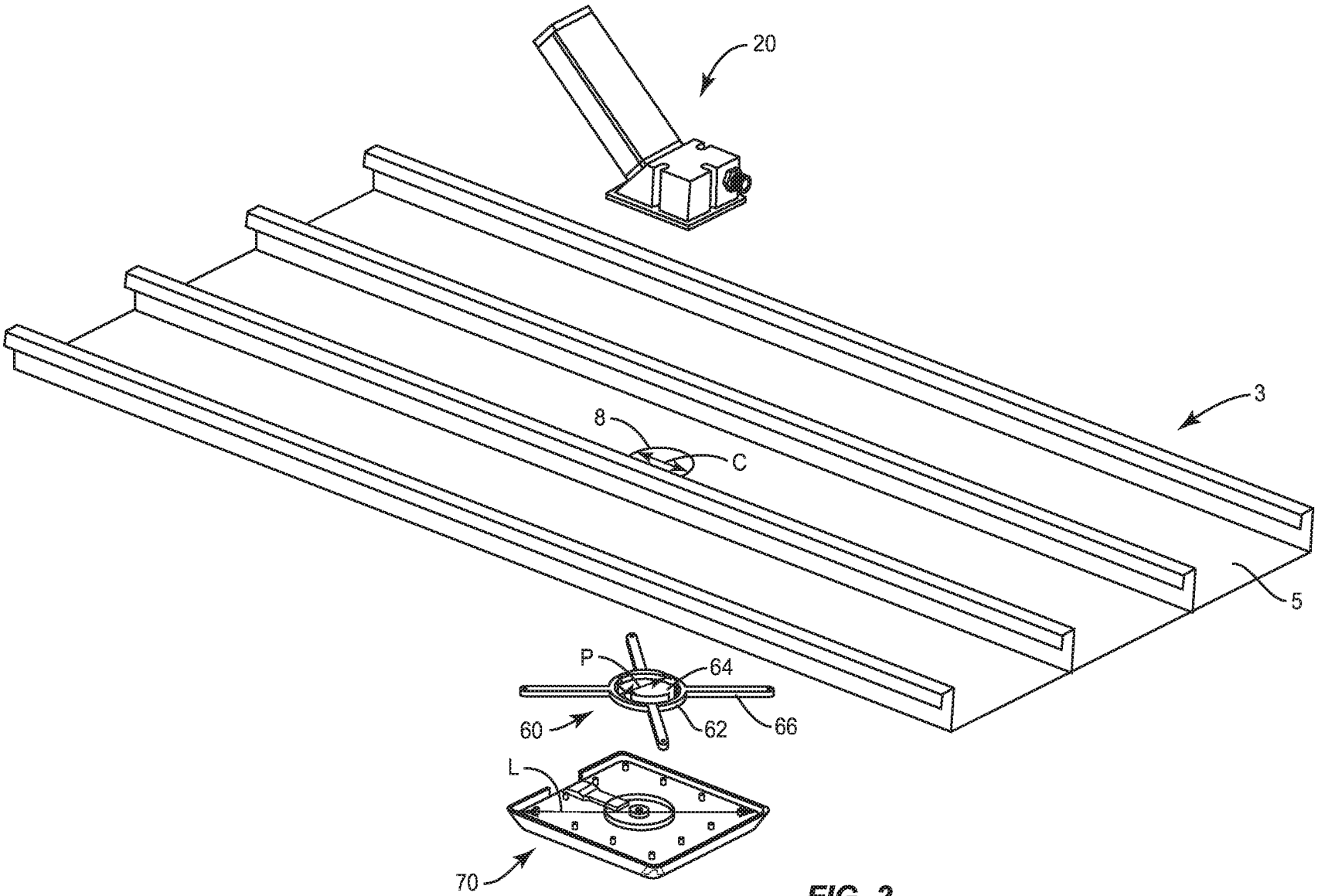
FIG. 2 shows a partially exploded view of a light fixture and an associated canopy.
Figure 3:
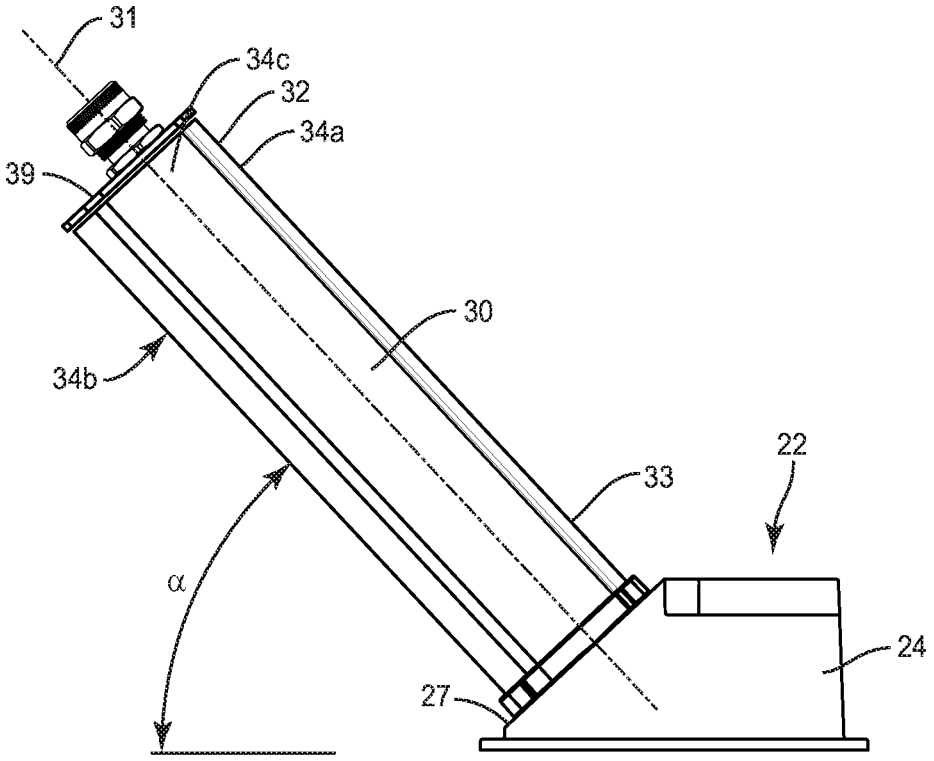
FIG. 3 shows a side view of a driver assembly.
Figure 4:
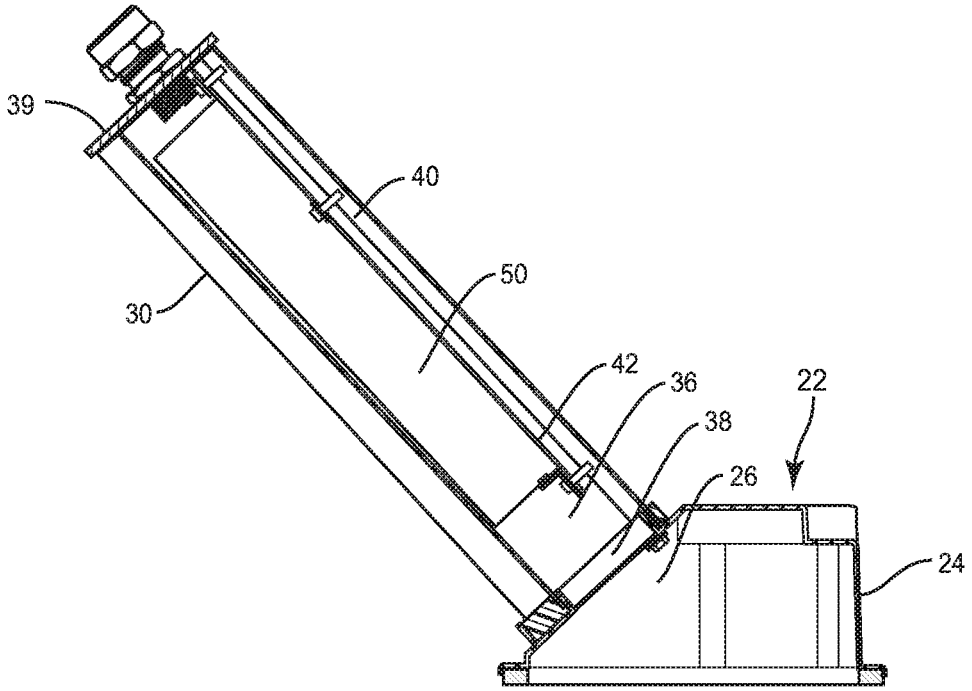
FIG. 4 shows a cross-sectional view of the driver assembly of FIG. 3.
Figure 5:
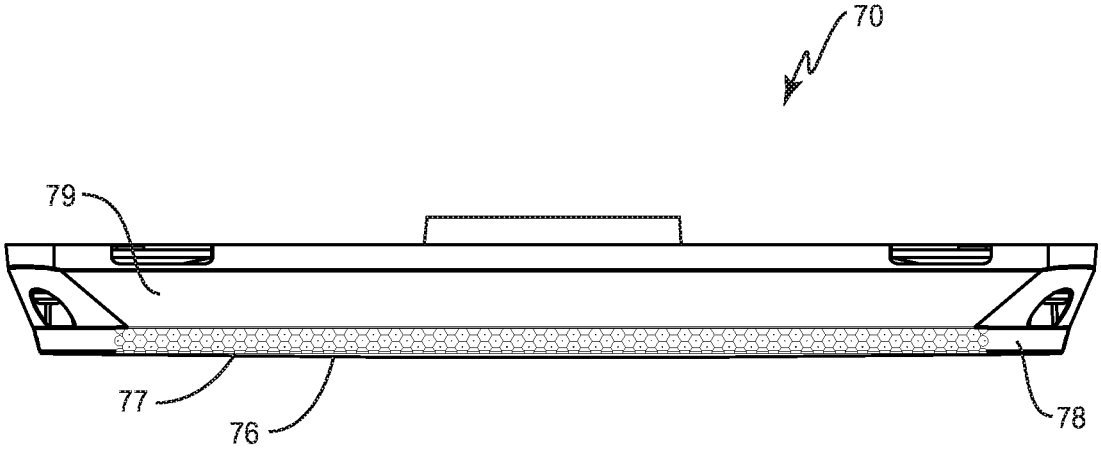
FIG. 5 shows a side view of a light-emitting assembly.
Figure 6:
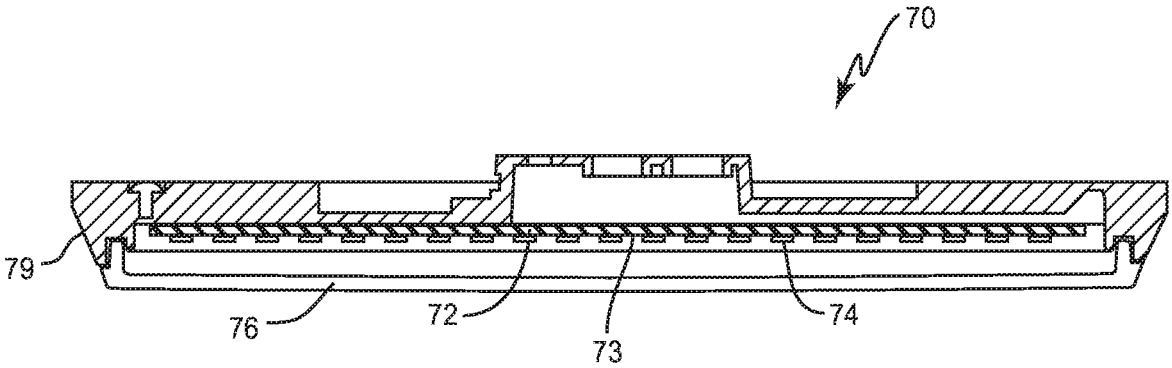
FIG. 6 shows a cross-sectional view of the light-emitting assembly of FIG. 5.
Figure 7:
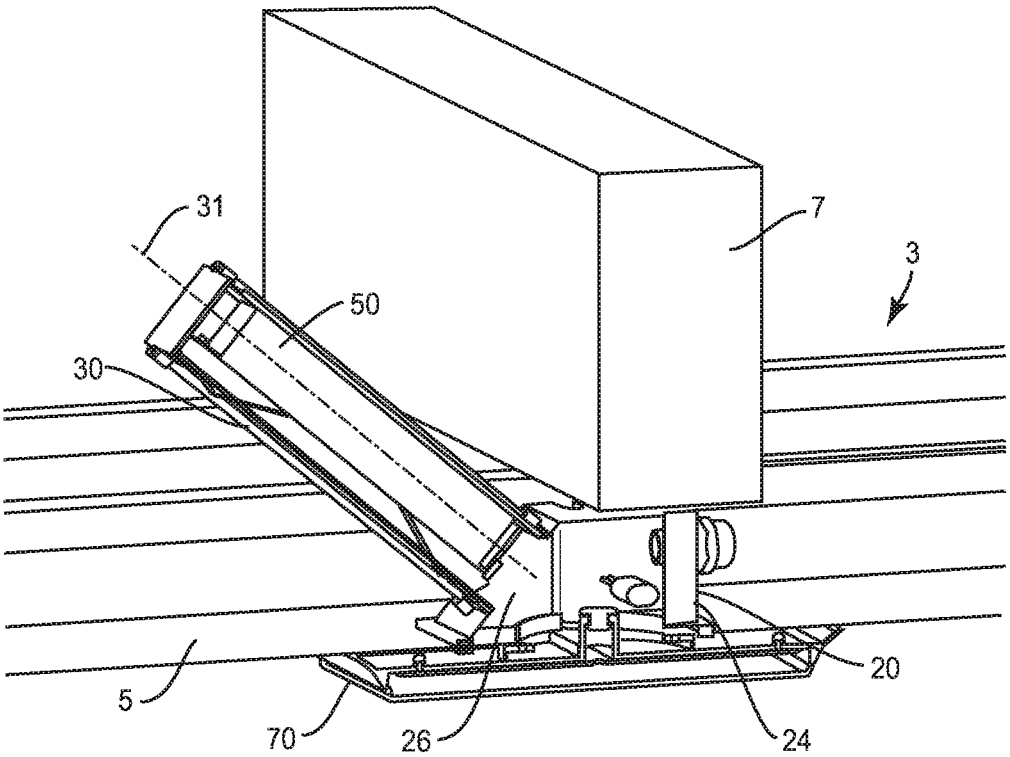
FIG. 7 shows a cross-sectional view of a light fixture installed on a canopy.
Figure 8:
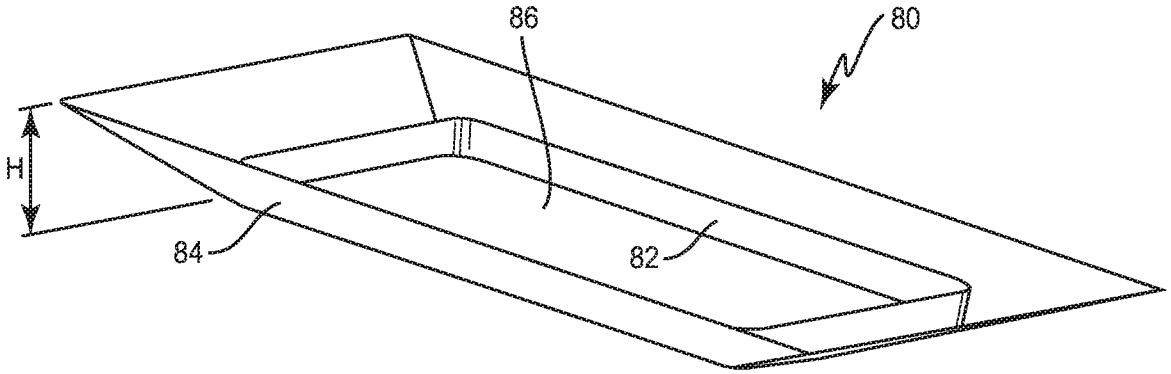
FIG. 8 shows a perspective view of a bezel.
Figure 9:
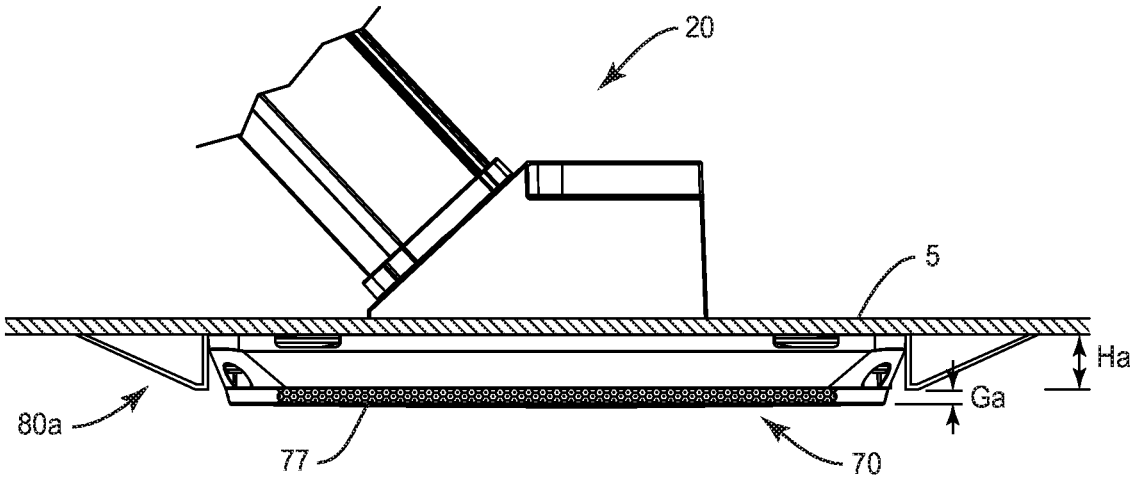
FIG. 9 shows a cross-sectional side view of a bezel disposed around a light-emitting assembly.
Figure 10:
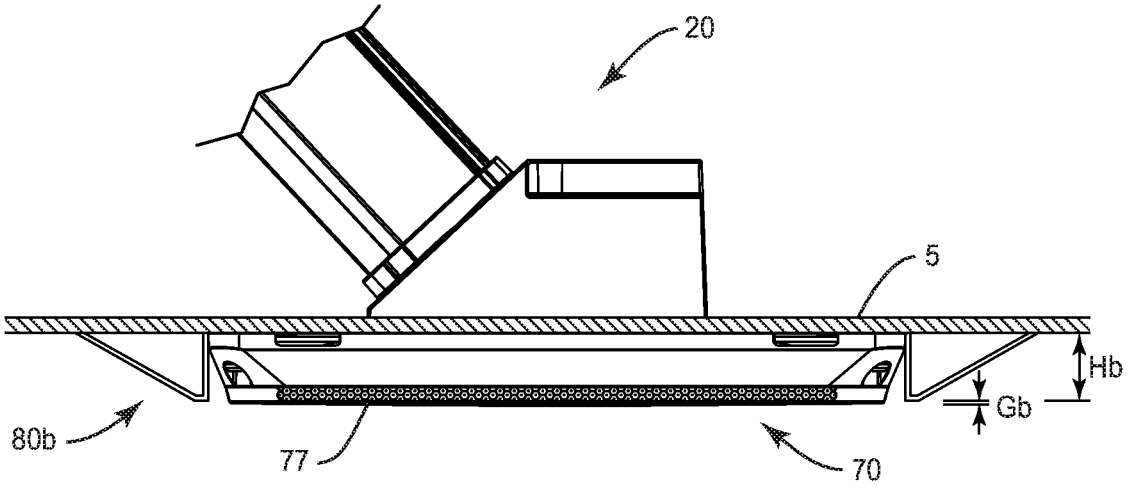
FIG. 10 shows a cross-sectional side view of another bezel disposed around a light-emitting assembly.
Figure 11:
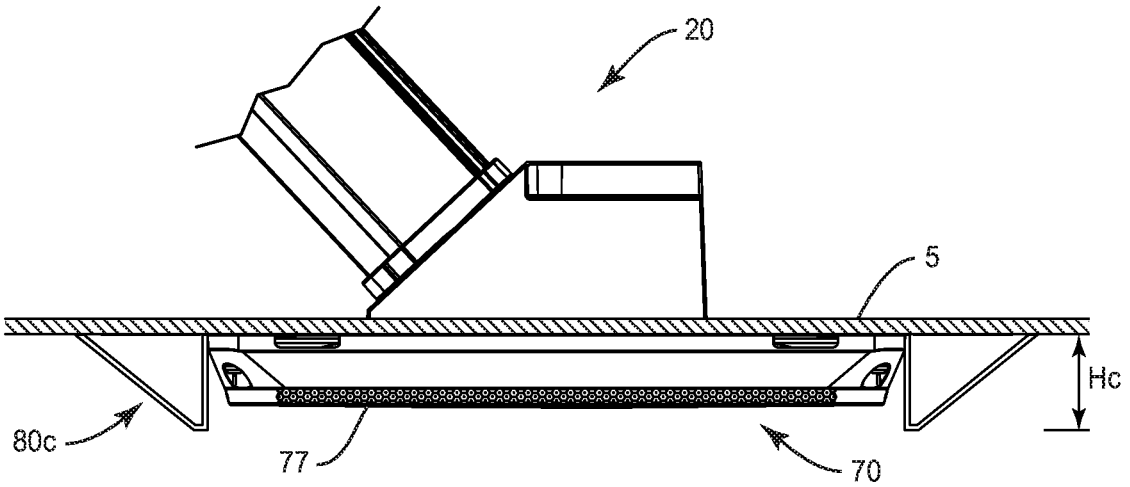
FIG. 11 shows a cross-sectional side view of another taller bezel disposed around a light-emitting assembly.

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure, and will recognize applications of these concepts not particularly addressed herein. It should be understood that these concepts and applications fall within the scope of the disclosure and the accompanying claims.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present disclosure. As used herein, the term "and/or" includes any and all combinations of one or more of the associated listed items.

It will be understood that when an element such as a layer, region, or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. Likewise, it will be understood that when an element such as a layer, region, or substrate is referred to as being "over" or extending "over" another element, it can be directly over or extend directly over the other element or intervening elements may also be present. In contrast, when an element is referred to as being "directly over" or extending "directly over" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" may be used herein to describe a relationship of one element, layer, or region to another element, layer, or region as illustrated in the Figures. It will be understood that these terms and those discussed above are intended to encompass different orientations of the device in addition to the orientation depicted in the Figures.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises," "comprising," "includes," and/or "including" when used herein specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms used herein should be interpreted as having a meaning that is consistent with their meaning in the context of this specification and the relevant art, and will not be interpreted in an idealized or overly formal sense unless expressly so defined herein.

In one or more aspects, the present disclosure is directed to an overhead light fixture 10 for mounting to a canopy 3. As shown in FIGS. 1-11 and 13-19, the overhead light fixture 10 (or simply "light fixture") includes a driver assembly 20 and a light-emitting assembly 70. The driver assembly 20 mounts above the canopy sheet 5, and includes a housing 22 and a driver 50 detachably secured in the housing 22. The housing 22 includes a base portion 24 and a sleeve portion 30 that projects upwardly away from the base portion 24. In some aspects, the base portion 24 is advantageously generally block-like so as to form an internal cavity 26, with a sloped outer face 27 facing the sleeve portion 30. The sleeve portion 30 advantageously takes the form of a generally tubular structure, with any suitable internal cross-section (which may be constant and/or varying). Thus, sleeve portion 30 typically has an upper wall 34*a*, a lower wall 34*b*, and sidewalls 34*c* disposed about an internal passage 36. The internal passage 36 is intended to receive the driver 50. Note that the sloped outer face 27 of the base portion 24 includes an opening that is aligned with the internal passage 36 of the sleeve portion 30, so that internal passage 36 opens into the internal cavity 26 of the base portion 24. The sleeve portion 30 has an upper end 32 and a lower end 33, with the lower end 33 being disposed closer to the base portion 24. The upper end 32 of the sleeve portion 30 is optionally closed by cover plate 39. The sleeve portion 30 may be any suitable shape, such as linear, curved, angled, and any mix thereof. The sleeve portion 30 shown in FIGS. 1-4, 7, 9-11, 16, and 18-19 is linear and extends along a sleeve axis 31. Note that sleeve axis 31 is angled from vertical, at an angle relative to horizontal referred to as projection angle α. Projection angle α can be 0° (so sleeve portion 30 is horizontal) to anywhere less than 90°. The projection angle α is advantageously in the range of about 30° to about 60°, and more advantageously about 45°. Suitable gaskets 38 are optionally advantageously employed to help seal the various components of the housing 22, and optionally advantageously between the base portion 24 and the upper face of the canopy sheet 5.

The driver 50 is suitable for driving the light source and is operatively connected thereto. Details of the driver 50 are not important for understanding the concepts herein, and are omitted for clarity. In some aspects, the driver 50 is detachably secured directly to the sleeve portion 30. However, in other aspects, the driver 50 is detachably secured indirectly to the sleeve portion 30. For example, the driver 50 may form a portion of a tray assembly 40 that is detachably secured to sleeve portion 30. The tray assembly 40 includes a driver tray 42 and the driver 50. The driver tray 42 is configured to be slidably received in the internal passage 36 of the sleeve portion 30. Note that in some aspects, the driver 50 is mounted on the top side of the driver tray 42 when installed, so that the driver 50 is disposed above the driver tray 42 when secured in the sleeve portion 30, and in some aspects the driver 50 is mounted on the underside of the driver tray 42 when installed, so that the driver 50 is disposed below the driver tray 42 when secured in the sleeve portion 30. In order to facilitate the sliding appropriately, the driver tray 42 and/or the interior faces of the sleeve portion 30 optionally include suitable features, such as guide rails and/or inter-engaging guides, that help keep the driver tray 42 properly positioned and oriented relative to the sleeve portion 30 during the sliding of the driver tray 42 into and/or out of the sleeve portion 30. Optionally also connected to the driver tray 42 is a surge circuit and/or a dimming circuit. The driver 50, and optionally the surge circuit and/or the dimming circuit, are detachably secured to the driver tray 42 by any suitable means, such as screws, clips, mounting brackets, adhesive, and the like. In some aspects, the sleeve portion 30 and the driver tray 42 are optionally configured so that the driver 50 abuts against the inner face of a wall (such as upper wall 34*a* or lower wall 34*b*) of the sleeve portion 30. This abutment allows for better heat transfer away from the driver 50 via the sleeve portion 30.

The light-emitting assembly 70 includes a light source 72, a lens 76, and an engine housing 79. The light source 72 may take any suitable form known in the art, but typically includes a generally planar circuit board 73 with a plurality of LEDs 74 mounted thereon. The LEDs 74 are arranged in an array, which may be regular or irregular in arrangement. The light source 72 mounts to the engine housing 79. The engine housing 79 is designed to be mounted directly and/or indirectly to the canopy sheet 5 from below. The engine housing 79 provides a means to support and position the light-emitting assembly 70. The lens 76 is disposed below the light source 72, is supported by the engine housing in alignment with the light source 72, and includes an exposed lower face 77 that forms the lower face of the light-emitting assembly 70, and side face(s) 78 that are optionally at least partially exposed. The lens 76 may include optical features to direct and/or shape the light emitted by the light-emitting assembly 70. The majority of the light emitted by the light-emitting assembly 70 is directed downward. However, some light may be emitted laterally, such as out the side face(s) 78 of the lens 76. For ease of reference, light emitted from a light source 72 at angles of 60° or more relative to the average light emission direction of the light source 72 may be referred to as "sparkle light". The light-emitting assembly 70, and thus the light source 72, lens 76, and engine housing 79 can be any suitable shape in plan view, such as round, oval, rectangular (including square), hexagonal, etc., including combinations thereof and irregular shapes. The light-emitting assembly 70 shown in FIGS. 1-2, 5-7, 9-11, 15, and 18-19 is generally rectangular for illustrative purposes only. The light-emitting assembly 70 has a size L corresponding to its largest orthogonal dimension.

As discussed above, the canopy 3 includes a canopy sheet 5, which is advantageously disposed horizontally. The canopy sheet 5 is most typically sheet metal, but may be of other materials. The canopy sheet 5 includes a canopy opening (sometimes referred to as a fixture-receiving opening) 8 that corresponds to the light fixture 10. The canopy opening 8 is typically round, but may take any suitable shape. In plan view, the canopy opening 8 has a size C that is smaller than the size L of the light-emitting assembly 70, and is smaller than the base portion 24 of the driver assembly 20. Note that when installed, the driver assembly 20 is disposed above the canopy sheet 5 and the light-emitting assembly 70 is disposed below the canopy sheet 5. The base portion 24 of the driver assembly 20 is typically mounted to the upper side of the canopy sheet 5, centered above the canopy opening 8, with the sleeve axis 31 advantageously intersecting the center of the canopy opening 8. The light-emitting assembly 70 is mounted to the underside of canopy sheet 5, and is also advantageously centered relative to the canopy opening 8. The electrical/control interconnections between the driver 50 and the light-emitting assembly 70 flow through the canopy opening 8.

In some aspects, the light fixture 10 also includes a mounting bracket 60 that is disposed between the light-emitting assembly 70 and the driver assembly 20. The mounting bracket 60 is configured to mount to the underside of the canopy sheet 5, and provides some additional rigidity to the resulting structure, as well as providing a common mounting element. The light-emitting assembly 70 may be detachably mounted to the canopy 3 via the mounting bracket 60, with the light-emitting assembly 70 mounting directly to the mounting bracket 60, and the mounting bracket 60 mounting directly to the canopy sheet 5 (or optionally via a suitable gasket). Likewise, the driver assembly 20 may be mounted to the canopy sheet 5 from above, and secured to the mounting bracket 60 through the canopy sheet 5. The mounting bracket 60 has a pass-through opening 64 that is intended to be aligned with the canopy opening 8. The pass-through opening 64 has a size P, and is advantageously similarly shaped as the canopy opening 8. The size P is smaller than the size of the light-emitting assembly 70, and is advantageously less than 50% of size of the light-emitting assembly 70, and more advantageously not more than 30% of size of the light-emitting assembly 70. The mounting bracket 60 may take any suitable form, such as a simple plate with holes. However, the mounting bracket 60 advantageously includes a central region 62 with a plurality of arms 66 extending outward therefrom. There may be any suitable number of arms 66, such as three, four, five, etc. The pass-through opening 64 is located in the central region 62. In some aspects, the light fixture 10 does not include a mounting bracket 60, and/or only one of the driver assembly 20 and the light-emitting assembly 70 mount to the canopy sheet 5 via the mounting bracket 60.

In some aspects, the light fixture 10 may optionally include a bezel 80 disposed peripherally about the light-emitting assembly 70, for improved appearance and/or protection and/or functioning. When installed, the optional bezel 80 peripherally surrounds the lens 76 in plan view (from below). The bezel 80 includes an inner face 82 and an outer face 84, and defines a central opening 86. The outer face 84 is typically sloped, so that, when installed, the outboard portions of bezel 80 slope toward the canopy 3. The inner face 82 bounds central opening 86. The inner face 82 may be vertical (relative to lower face 77 of lens 76), or may be sloped, as is desired. The central opening 86 is configured to receive the light-emitting assembly 70, in particular the lens 76. When viewed in cross-section, the bezel 80 has a height H. As discussed further below, bezels of differing heights may be employed to achieve different visual effects. Note that in some aspects, light fixture 10 does not include the bezel 80.

The light fixture 10 is initially installed on the canopy 3 by accessing the canopy 3 from above and from below the canopy sheet 5. The following discussion will assume a mounting bracket 60 is employed, but such is not required. A suitable canopy opening 8 is formed if not already present. See FIG. 13. Typically, the canopy opening 8 is formed from below, and the canopy hole 8 (when round) is advantageously not more than four inches in diameter, so that size C is four inches or less. The mounting bracket 60 is mounted to the underside of the canopy sheet 5 via screws or the like. See FIG. 14. From below, the light-emitting assembly 70 is secured to canopy 3 by being mounted to the mounting bracket 60. See FIG. 15. From above, the driver assembly 20 is mounted to the upper side of the canopy sheet 5 by being secured to the mounting bracket 60. See FIG. 16. The base portion 24 of the driver assembly 20 overlaps the light-emitting assembly 70 and is aligned with the canopy opening 8, so that the canopy opening 8 aligns with the internal cavity 26 of the base portion 24, advantageously such that the sleeve axis 31 extends through the canopy opening 8. The driver 50 may be present in the shell housing, or may be installed later, such as by being slid into position in the sleeve portion 30 by being inserted through the pass-through opening 64 and the canopy opening 8 into the internal passage 36 of the sleeve portion 30, and properly secured. Appropriate electrical connections are made, e.g., supply power is connected to the driver assembly 20, and the driver 50 operatively connected to the light-emitting assembly 70. Caulk or other sealing materials are then applied as needed to seal around any openings the canopy 3 appropriately. Note that the driver assembly 20 and the light-emitting assembly 70 are disposed on opposing sides of the canopy 3 and the mounting bracket 60.

From the discussion above, it can be seen that the light fixture 10, in some aspects, includes a driver assembly 20 and a light-emitting assembly 70. The driver assembly 20 includes a driver 50 and a housing 22; with the housing 22 having a base portion 24 and a sleeve portion 30 extending upwardly from the base portion 24 at an angle $\alpha$ less than vertical. The driver 50 is detachably mounted in the sleeve portion 30. The light-emitting assembly 70 is operably connected to the driver 50 and configured for downward emission of light from a light source 72 of the light-emitting assembly 70. The light-emitting assembly 70 is detachably secured to the base portion 24 of the driver assembly 20. The driver assembly 20 is configured so that, when the light-emitting assembly 70 is detached from base portion 24, the driver 50 is removable downwardly through the base portion 24.

It should be noted that the angled orientation of the driver 50 provides flexibility during installation. For example, when a beam 7 of the canopy 3 is located so as to overlap the canopy opening 8, a vertical orientation of the driver 50 may not be possible due to interference by the beam 7. However, disposing the driver 50 as described above (e.g., in a sleeve portion 30 at a non-vertical angle $\alpha$), allows the driver assembly 20 to be partially overlapped by the beam 7, but the driver 50 to be positioned away from the beam 7, so that no interference is created. This allows greater flexibility in locating the canopy opening 8 and corresponding light fixtures 10.

In addition, in some aspects, the driver assembly 20 is configured so that is can be secured to the light-emitting assembly 70 in a plurality of orientations relative to the light-emitting assembly 70. For example, the driver assembly 20 may be configured so that is can mount to the mounting bracket 60 (and/or canopy sheet 5) in any one of a plurality of relative rotational orientations relative to the light-emitting assembly 70. For example, assume that the driver assembly 20 can be secured to the mounting bracket 60 in any one of four different rotational orientations so that the sleeve portion 30 can extend in any one of four conceptual directions. With such a design, the sleeve portion 30 of the driver assembly 20 may be oriented in one direction (e.g., "east"), when an orientation of a different direction (e.g., "west") would create interference and/or have less desirable access. Note that selection of the orientation for driver assembly 20 (relative to the canopy 3) does not mandate a particular orientation of the corresponding light-emitting assembly 70, due to the allowed variability in relative rotational orientations for such a design. Of course, any number of relative positions are envisioned, but four is believed suitable for most situations. Allowing flexibility in installation orientation for the driver assembly 20, without impacting the orientation of the light-emitting assembly 70 relative to the canopy 3, allows for easier and more reliable installation.

The light-emitting assembly 70 is configured for downward emission of light from a light source 72 of the light-emitting assembly 70 when installed. Light may also be emitted laterally downward, but at an (non-zero) angle to vertical. Such lateral light emissions may be undesirable in some situations, and desirable in other situations. In some aspects, the degree of lateral emission of light coming from light fixture 10 may be controlled by an optional associated bezel 80.

In one approach, bezels 80 of different heights may be offered, such as a first bezel **80*a* and a second bezel 80*b*. Both the first bezel 80*a* and the second bezel 80*b* are as described above, but are of differing heights. Thus, both the first bezel 80*a* and the second bezel 80*a* are configured to be disposed around the lens 76 of the light-emitting assembly 70 (as alternatives, not simultaneously). For purposes of discussion, assume that the height Ha of the first bezel 80*a* less than the height Hb of the second bezel 80*b*; that is, the second bezel 80*b* is taller. The height Ha of the first bezel 80*a* is less than the light-emitting assembly 70, so that, in side view, the first bezel 80*a* forms a first vertical gap Ga with the lower face 77 of the lens 76 when disposed around the lens 76. The height Hb of the second bezel 80***b* is more than the height Ha of the first bezel 80*a*, so, in side view, the second bezel 80*b* forms a second vertical gap Gb with the lower face 77 of the lens 76 when disposed around the lens 76. In some aspects, the second bezel 80*b* is flush with the lower face 77, so the second vertical gap is not present. Due to their differing heights, the first bezel 80*a* will block a first portion of the lateral light emitted from the lens 76 when it is disposed around the lens 76, while the second bezel 80*b* will block a second portion of the lateral light emitted from the light-emitting assembly 70 when it is disposed around the lens 76, with the second portion being greater than the first portion. The heights H of the bezels 80*a*, 80*b* may be such that the lens 76 appears to protrude from the bezel 80 when the first bezel 80*a* is used (see FIG. 9), and is either less protruding (see FIG. 10) or flush mounted when the second bezel 80*b* is used. This example can be extended to three or more bezels 80 of different heights. In addition, the second bezel 80*b* (or third, etc.) may have sufficient height H so as block substantially all of the laterally emitted light, such as by being flush or by having a height H such that it extends below the lower surface 77 and thereby making the lens fully recessed relative to the bezel 80. For example, a third bezel 80*c* may be used that has a height Hc that is more than the height Hb of the second bezel 80*b*, such that the lens 76 is fully recessed with respect to the bezel 80*c* (see FIG. 11).

In some aspects, bezels 80 of the same height H but different optical properties may be offered. For example, a first bezel 80 may pass a first portion of lateral light from the lens 76 with a first attenuation, while a second bezel 80 may pass a second portion of lateral light from the lens 76 with a second, higher, attenuation. The difference in attenuation may be achieved with a difference in materials, a difference in material thickness or density, and/or a difference in color. Of course, the approaches of varying height and varying attenuation may be combined as well.

From the discussion above, it can be seen that the light fixture 10, in some aspects, includes a driver assembly 20, a light-emitting assembly 70, and a bezel 80. The driver assembly 20 includes a driver 50 and a housing 22, with the housing 22 having a base portion 24 and a sleeve portion 30 extending upwardly from the base portion 24. The driver 50 is mounted, optionally detachably mounted, in the sleeve portion 30. The light-emitting assembly 70 is disposed below the driver assembly 20 and detachably secured to the base portion 24 of the driver assembly 20. The light-emitting assembly 70 has a lens 76 configured for downward and lateral emission of light from light source 72 of the light-emitting assembly 70. The bezel 80 peripherally surrounds the lens 76 and controls a degree of lateral emission of light from the light fixture 10. The driver assembly 20 is configured so that, when the light-emitting assembly 70 is detached from base portion 24, the driver 50 is removable downwardly through the base portion 24.

In some aspects, the bezel 80 is either a first bezel 80*a* or a second bezel 80*b*. The first bezel 80*a* is configured to be disposed around the lens 76 and block a first portion of light laterally emitted from the lens 76 when disposed around the lens 76. The second bezel 80*b* is configured to be disposed around the lens 76 and block a second portion of light laterally emitted from the lens 76 when disposed around the lens 76; wherein the second portion is greater than the first portion. In some aspects, the first bezel 80 has a smaller height Ha than a height Hb of the second bezel 80.

Figure 12:
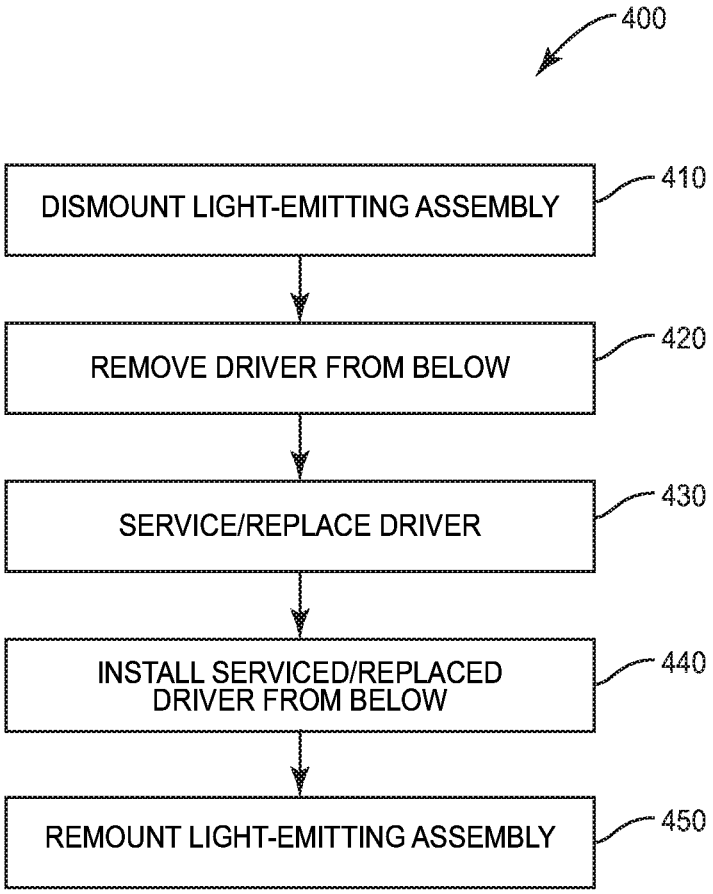
FIG. 12 shows a simplified process flow chart for a method of servicing an overhead light fixture installed in an overhead canopy.
Figure 13:
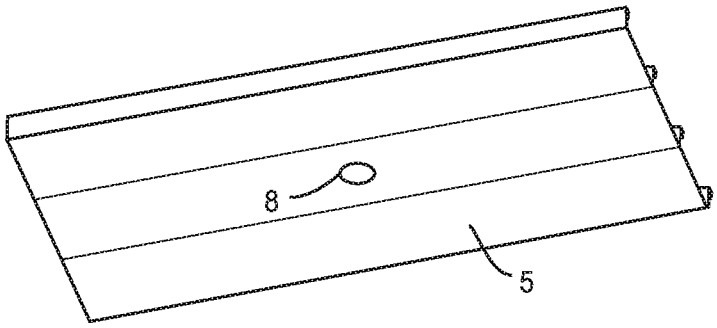
FIG. 13 shows a lower perspective view of a canopy with a canopy opening.
Figure 14:
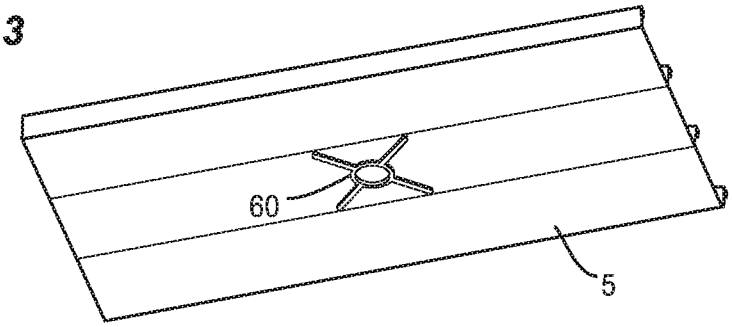
FIG. 14 shows the canopy of FIG. 13 with a mounting bracket added.
Figure 15:
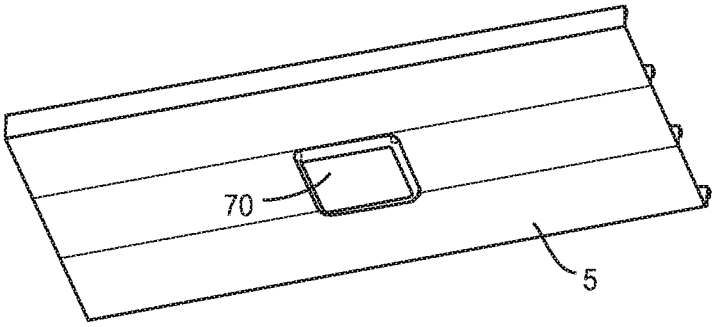
FIG. 15 shows the canopy of FIG. 14 with a light-emitting assembly added.
Figure 16:
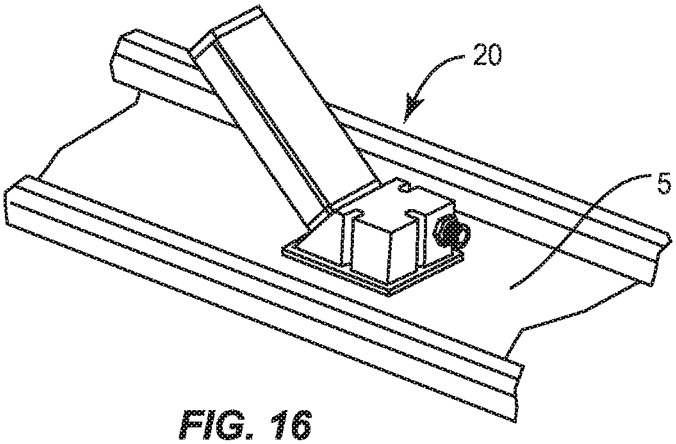
FIG. 16 show an upper perspective view of the canopy of FIG. 15 with a driver assembly added.
Figure 17:
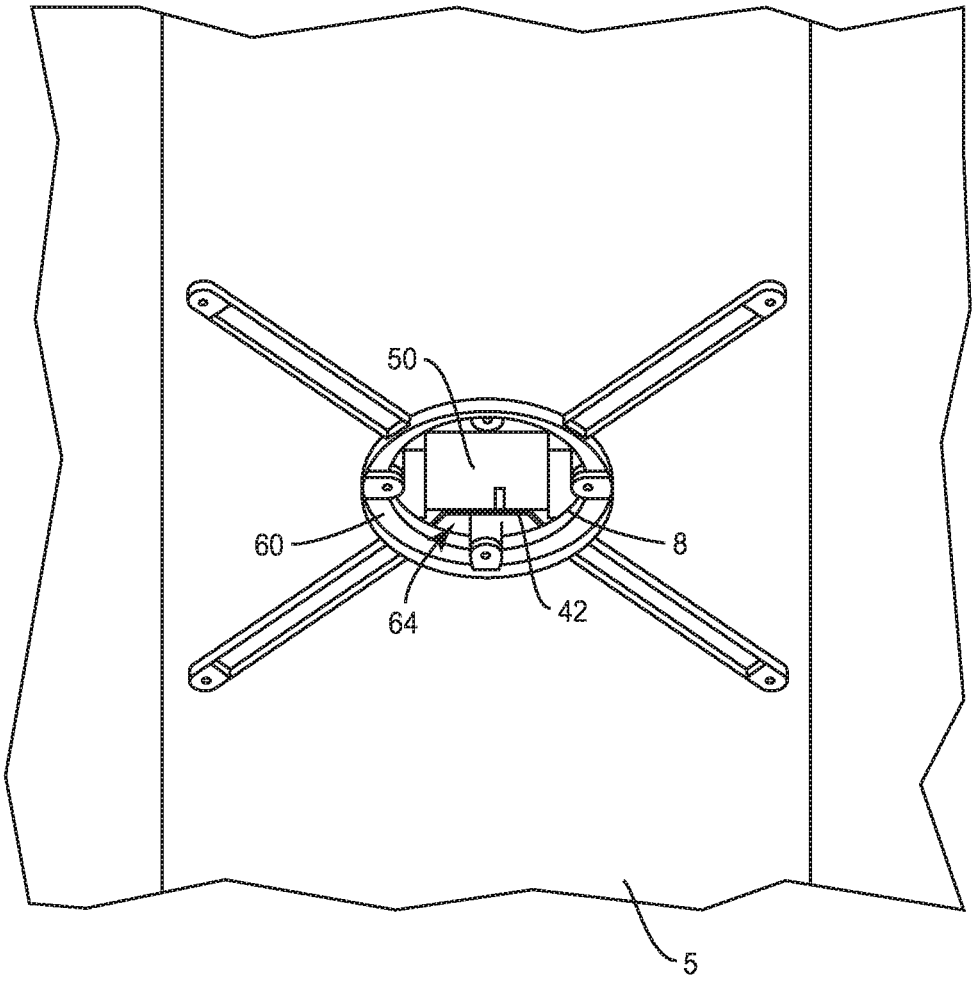
FIG. 17 shows a perspective view, from below, of the light fixture of FIG. 1 mounted to a canopy sheet, with an optional mounting bracket and with the light-emitting assembly omitted/dismounted.
Figure 18:
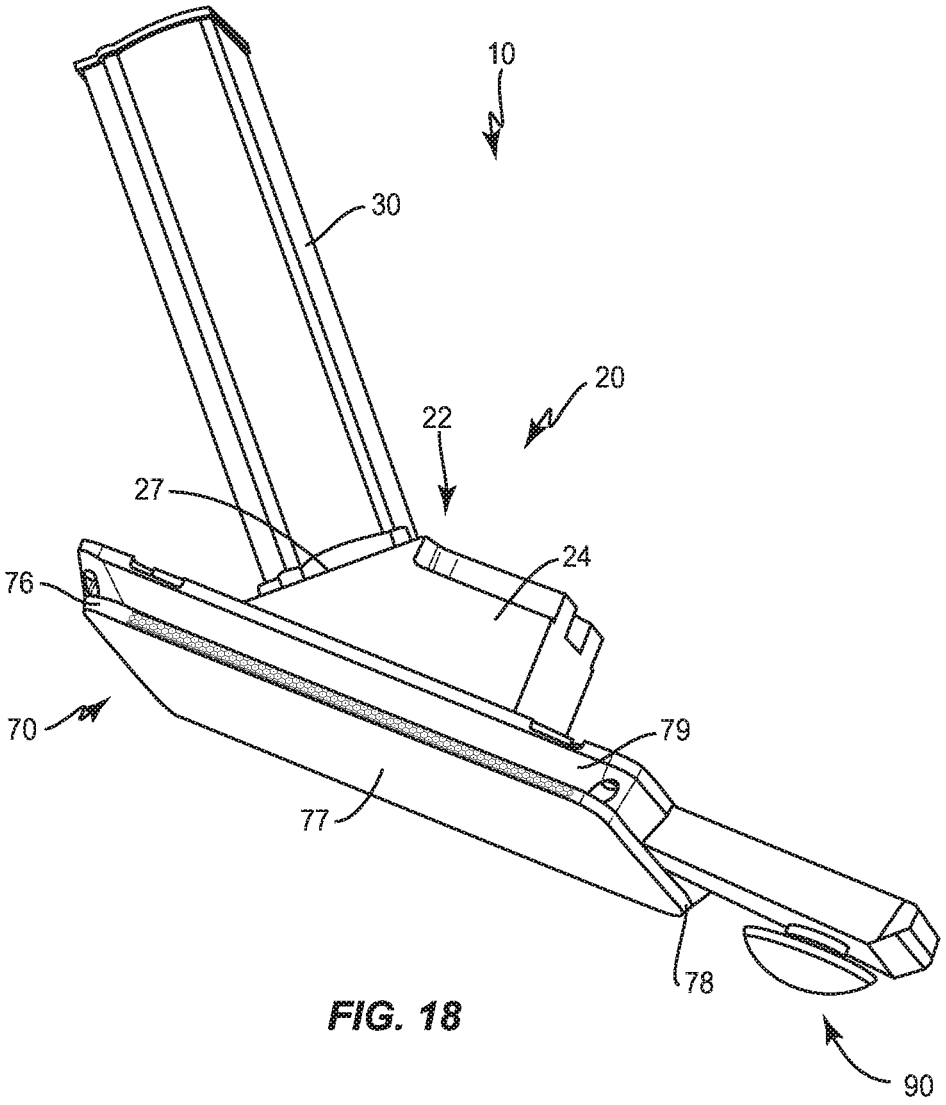
FIG. 18 shows a perspective view of the light fixture of FIG. 1, with an optional occupancy sensor.
Figure 19:
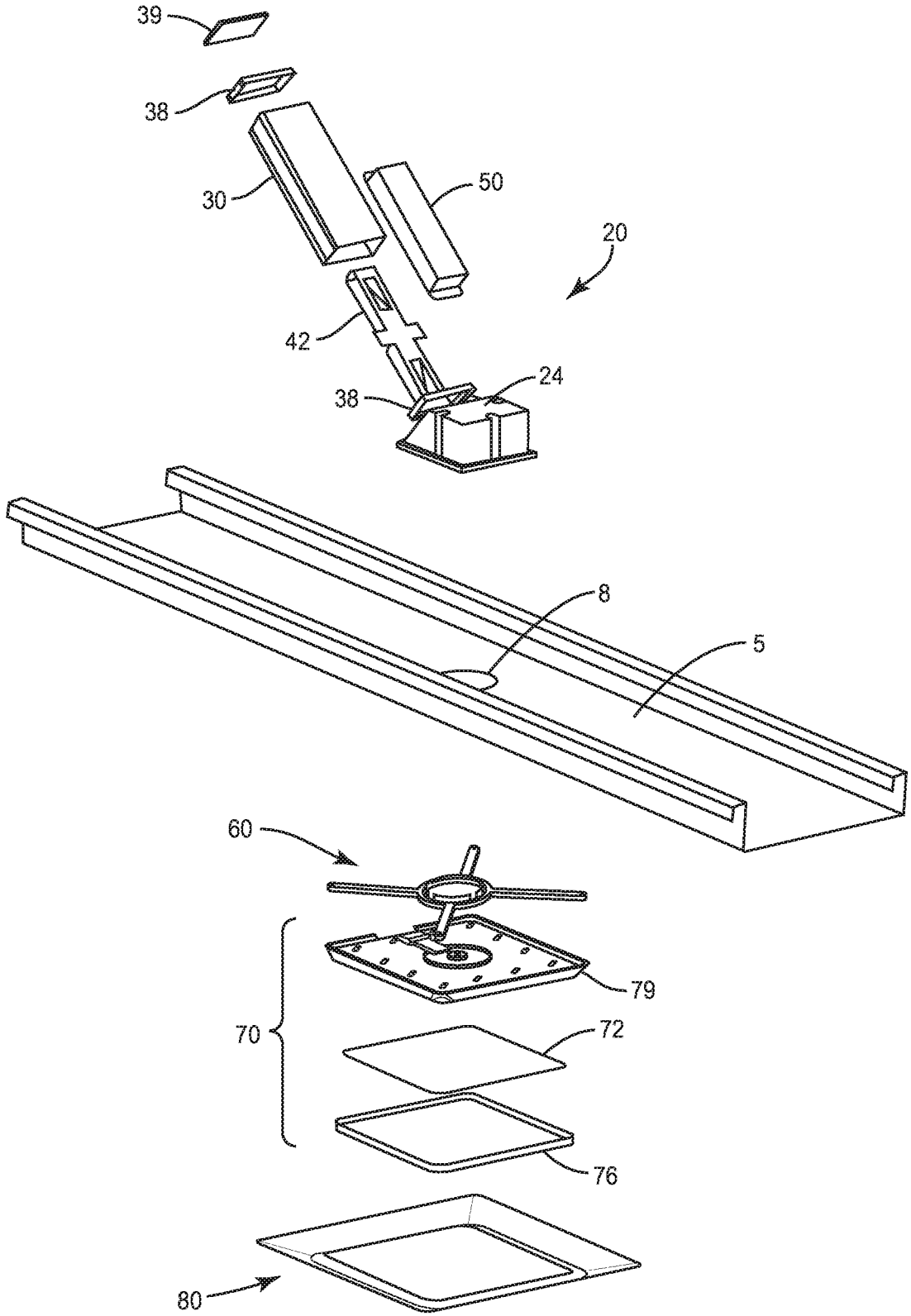
FIG. 19 shows a more exploded view of the light fixture of FIG. 2, with an associated canopy.

The light fixtures 10 described herein may their drivers 50 serviced or replaced from below. A method (400) of servicing an overhead light fixture 10 installed in an overhead canopy 3 is shown FIG. 12. As discussed above, the canopy 3 has a canopy sheet 5 and a fixture-receiving opening 8 therethrough. As further described above, the overhead light fixture 10 includes a driver assembly 20 and a light-emitting assembly 70. The light-emitting assembly 70 is detachably secured to the canopy 3 and configured for downward emission of light from the light source 72 of the light-emitting assembly 70. The driver assembly 20 includes a driver 50 operatively connected to the light source 72. The driver assembly 20 is disposed above the canopy 3 and the light-emitting assembly 70 is disposed below the canopy 3. Starting with a light fixture 10 installed on the canopy 3, the method includes dismounting (410) the light-emitting assembly 70 from the canopy 3. FIG. 17 shows a simplified view from below at this point in the process, with the optional mounting bracket 60 present. As can be seen in FIG. 17, the driver 50 is accessible from below through the canopy opening 8 (and pass-through opening 64 of mounting bracket 60). The method continues with thereafter, removing (420) the driver 50 from below the canopy 3 by moving the driver 50 downward out the fixture-receiving opening. The method continues with, while the driver 50 is removed, servicing or replacing (430) the driver 50 with a replacement driver 50. The serviced or replacement driver 50 is installed (440) by moving the serviced or replacement driver 50 upward through the fixture-receiving opening 8. Once the serviced or replacement driver 50 is secured in position, the resulting view at this point in the process would be similar to that show in FIG. 17, but with the serviced or replacement driver 50 rather than the original driver 50. The method continues with remounting (450) the light-emitting assembly 70 to the canopy 3 and operatively connecting the light-emitting assembly 70 to the serviced or replacement driver 50. The operatively connecting may be a result of installing the driver, remounting the light-emitting assembly 70, or a separate operation performed at any suitable time.

As discussed above, in some aspects, the driver assembly 20 has a sleeve portion 30 extending upwardly away from the canopy sheet 5 at an angle $\alpha$ less than vertical, with the driver 50 detachably mounted in the sleeve portion 30. With such an arrangement, the removing (420) the driver 50 may include removing the driver 50 from the driver assembly 20 from below the canopy 3 by sliding the driver 50 out the sleeve portion 30 and out of the fixture-receiving opening 8, while maintaining the sleeve above the canopy 3. Likewise, the installing (440) may include sliding the serviced or replacement driver 50 upward through the fixture-receiving opening 8 and upward into the sleeve portion 30.

As discussed above, in some aspects, the driver assembly 20 includes a tray assembly 40 comprising a driver tray 42, with the driver 50 secured to driver tray 42. With such an arrangement, the removing (420) the driver 50 may include sliding the driver tray 42 along the sleeve portion 30.

In some aspects, the dismounting (410) the light-emitting assembly 70 comprises dismounting the light-emitting assembly 70 from a mounting bracket 60 secured to an underside of the canopy 3; the mounting bracket 60 having a pass-through opening 64 aligned with the fixture-receiving opening 8. With such an arrangement, the installing (440) may include sliding the serviced or replacement driver 50 upward through the pass-through opening 64; and the remounting (450) the light-emitting assembly 70 to the canopy 3 may include remounting the light-emitting assembly 70 to the mounting bracket 60.

The discussion above has generally been in the context of the light source 72 being LED based. However, it should be understood that the light source 72 could use any other technology known in the art, such as incandescent, light panels, florescent, etc., either alone or in combination with LEDs.

In some aspects, the light fixture 10 may further include an optional sensor 90 for detecting motion and/or when a person and/or vehicle is in the area lighted by the light fixture 10. See FIG. 18. The sensor 90 is operatively connected to the control circuitry (not shown) for the light fixture 10. In some aspects, the sensor 90 helps control the light source 72 of the light-emitting assembly 70, such as by causing one color of light to be emitted by light source 72 when no motion and/or no occupancy is detected, but another color of light to be emitted by light source 72 when motion and/or occupancy is detected, optionally with suitable hysteresis control between such modes. Brightness of the light emitted by light source 72 may likewise and/or additionally controlled in a similar manner. In some aspects, a single sensor 90 may be used to control a plurality of light fixtures 10, or each light fixture 10 may have a corresponding dedicated sensor 90. When light fixture 10 includes sensor 90 and a bezel 80, the bezel 80 advantageously includes a suitable notch or opening to allow mounting of the sensor to the light-emitting assembly 70.

The present invention may, of course, be carried out in other ways than those specifically set forth herein without departing from essential characteristics of the invention. The present embodiments are to be considered in all respects as illustrative and not restrictive, and all changes coming within the meaning and equivalency range of the appended claims are intended to be embraced therein. Although steps of various processes or methods described herein may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention.

What is claimed is:

1. An overhead light fixture for mounting to a canopy, comprising:

a driver assembly having a driver and a housing; the housing having a base portion and a sleeve portion extending upwardly from the base portion at an angle less than vertical; the driver detachably mounted in the sleeve portion;

a light-emitting assembly operably connected to the driver and configured for downward emission of light from a light source of the light-emitting assembly; the light-emitting assembly detachably secured to the base portion of the driver assembly and positioned below the driver assembly;

wherein the overhead light fixture is configured so that, when the light-emitting assembly is detached from the base portion, the driver is removable downwardly through the base portion and through a space previously occupied by the light-emitting assembly.

2. The overhead light fixture of claim 1:

further comprising a mounting bracket configured to be secured to the canopy; the mounting bracket having a pass-through opening;

wherein the light-emitting assembly and the driver assembly are secured to opposing sides of the mounting bracket.

3. The overhead light fixture of claim 2, wherein the pass-through opening is sized not more than 30% a size of the light engine.

4. The overhead light fixture of claim 1, wherein the angle is greater than 0° so that the sleeve portion is angled above horizontal.

5. The overhead light fixture of claim 4, wherein the angle is in the range of about 30 degrees to about 60 degrees.

6. The overhead light fixture of claim 1, wherein the sleeve portion is linear.

7. The overhead light fixture of claim 1, wherein the light fixture is configured such that the light-emitting assembly can be secured to the driver assembly at any one of a plurality of relative rotational orientations.

8. The overhead light fixture of claim 1, further comprising a bezel disposed peripherally about the light-emitting assembly.

9. The overhead light fixture of claim 1:

wherein the driver assembly comprises a tray assembly comprising a driver tray and the driver secured to the driver tray; and wherein the driver tray is secured in the sleeve portion so that the driver is protected by the sleeve portion.

10. An overhead light fixture for mounting to a canopy, comprising:

a driver assembly having a driver and a housing; the housing having a base portion and a sleeve portion extending upwardly from the base portion at an angle less than vertical; the driver detachably mounted in the sleeve portion;

a light-emitting assembly operably connected to the driver and configured for downward emission of light from a light source of the light-emitting assembly; the light-emitting assembly detachably secured to the base portion of the driver assembly and positioned below the driver assembly;

a mounting bracket configured to be secured to the canopy; the mounting bracket having a pass-through opening;

wherein a light engine and the driver assembly are secured to opposing sides of the mounting bracket; wherein the mounting bracket comprises a plurality of arms extending from a central region, wherein the pass-through opening is disposed in the central region;

wherein the overhead light fixture is configured so that, when the light-emitting assembly is detached from the base portion, the driver is removable downwardly through the base portion.

11. An overhead light fixture for mounting to a canopy, comprising:

a driver assembly having a driver and a housing; the housing having a base portion and a sleeve portion extending upwardly from the base portion; the driver mounted in the sleeve portion;

a light-emitting assembly disposed below the driver assembly and detachably secured to the base portion of the driver assembly, the light-emitting assembly having a lens configured for downward and lateral emission of light from a light source of the light-emitting assembly;

a bezel peripherally surrounding the lens and controlling a degree of lateral emission of light from the light fixture;

wherein the overhead light fixture is configured so that, when the light-emitting assembly is detached from the base portion, the driver is removable downwardly through the base portion through a space previously occupied by the light-emitting assembly.

12. The overhead light fixture of claim 11:

wherein the bezel is either a first bezel or a second bezel;

wherein the first bezel is configured to be disposed around the lens and block a first portion of light laterally emitted from the lens when disposed around the lens;

wherein the second bezel is configured to be disposed around the lens and block a second portion of light laterally emitted from the lens when disposed around the lens; wherein the second portion is greater than the first portion.

13. The overhead light fixture of claim 12, wherein the sleeve portion extends upwardly from the base portion at an angle less than vertical.

14. An overhead light fixture for mounting to a canopy, comprising:

a driver assembly having a driver and a housing; the housing having a base portion and a sleeve portion extending upwardly from the base portion; the driver mounted in the sleeve portion;

a light-emitting assembly disposed below the driver assembly and detachably secured to the base portion of the driver assembly, the light-emitting assembly having a lens configured for downward and lateral emission of light from a light source of the light-emitting assembly;

a bezel peripherally surrounding the lens and controlling a degree of lateral emission of light from the light fixture;

wherein the overhead light fixture is configured so that, when the light-emitting assembly is detached from the base portion, the driver is removable downwardly through the base portion;

wherein the bezel is either a first bezel or a second bezel;

wherein the first bezel is configured to be disposed around the lens and block a first portion of light laterally emitted from the lens when disposed around the lens;

wherein the second bezel is configured to be disposed around the lens and block a second portion of light laterally emitted from the lens when disposed around the lens; wherein the second portion is greater than the first portion; wherein the first bezel has a smaller height than a height of the second bezel.

15. The overhead light fixture of claim 14:

wherein the lens has a lower face disposed vertically downward farthest from the driver assembly;

wherein the height of the first bezel is such that the first bezel, in side view, forms a first vertical gap with the lower face when disposed around the lens;

wherein the height of the second bezel is such that, in side view, the second bezel forms a second vertical gap with, or is flush with, the lower face when disposed around the lens; the second vertical gap smaller than the first vertical gap.

16. A method of servicing an overhead light fixture installed in an overhead canopy; the canopy having a canopy sheet and a fixture-receiving opening therethrough; the overhead light fixture comprising a driver assembly and a light-emitting assembly; the light-emitting assembly detachably secured to the canopy and configured for downward emission of light from a light source of the light-emitting assembly; the driver assembly comprising a driver operatively connected to the light source; wherein the driver assembly is disposed above the canopy and the light-emitting assembly is disposed below the canopy; the method comprising:

dismounting the light-emitting assembly from the canopy;

thereafter, removing the driver from below the canopy by moving the driver downward out of the fixture-receiving opening and through a space previously occupied by the light-emitting assembly;

while the driver is removed, servicing or replacing the driver with a replacement driver;

installing the serviced or replacement driver by moving the serviced or replacement driver upward through the fixture-receiving opening;

remounting the light-emitting assembly to the canopy and operatively connecting the light-emitting assembly to the serviced or replacement driver.

17. The method of claim 16:

wherein the driver assembly further comprises a sleeve portion extending upwardly away from the canopy sheet at an angle less than vertical, wherein the driver is detachably mounted in the sleeve portion;

wherein the removing the driver comprises removing the driver from the driver assembly from below the canopy by sliding the driver out of the sleeve portion and out of the fixture-receiving opening, while maintaining the sleeve above the canopy;

wherein the installing comprises sliding the serviced or replacement driver upward through the fixture-receiving opening and upward into the sleeve portion.

18. The method of claim 16, wherein the servicing or replacing the driver assembly comprises replacing the driver.

19. The method of claim 16:

wherein the driver assembly comprises a tray assembly comprising a driver tray and the driver secured to the driver tray;

wherein the removing the driver comprises sliding the driver tray along the sleeve portion.

20. The method of claim 16:

wherein the dismounting the light-emitting assembly comprises dismounting the light-emitting assembly from a mounting bracket secured to an underside of the canopy; the mounting bracket having a pass-through opening aligned with the fixture-receiving opening;

wherein the installing comprises sliding the serviced or replacement driver upward through the pass-through opening;

wherein the remounting the light-emitting assembly to the canopy comprises remounting the light-emitting assembly to the mounting bracket.

* * * * *